US011566351B2

(12) United States Patent
Cobanoglu et al.

(10) Patent No.: US 11,566,351 B2
(45) Date of Patent: Jan. 31, 2023

(54) TEXTILE FABRIC IMPLEMENTING A CAPACITIVE GRID

(71) Applicant: Sanko Tekstil Isletmeleri San. Ve Tic. A.S., Inegol—Bursa (TR)

(72) Inventors: Ozgur Cobanoglu, Inegol—Bursa (TR); Deniz Iyidogan, Inegol—Bursa (TR); Ali Kemal Agirman, Inegol—Bursa (TR); Jitka Eryilmaz, Inegol—Bursa (TR)

(73) Assignee: Sanko Tekstil Isletmeleri San. Ve Tic. A.S., Inegol—Bursa (TR)

( * ) Notice: Subject to any disclaimer, the term of this patent is extended or adjusted under 35 U.S.C. 154(b) by 349 days.

(21) Appl. No.: 15/774,149

(22) PCT Filed: Nov. 8, 2016

(86) PCT No.: PCT/EP2016/076942
§ 371 (c)(1),
(2) Date: May 7, 2018

(87) PCT Pub. No.: WO2017/080984
PCT Pub. Date: May 18, 2017

(65) Prior Publication Data

US 2018/0327939 A1 Nov. 15, 2018

(30) Foreign Application Priority Data

Nov. 9, 2015 (EP) ..... 15193723

(51) Int. Cl.
*D03D 1/00* (2006.01)
*D03D 11/00* (2006.01)
*D03D 15/47* (2021.01)

(52) U.S. Cl.
CPC ..... *D03D 1/0088* (2013.01); *D03D 11/00* (2013.01); *D03D 15/47* (2021.01);
(Continued)

(58) Field of Classification Search
CPC ..... D10B 2493/02431; D10B 2101/20; D10B 2201/02; D10B 2331/02; D10B 2331/04;
(Continued)

(56) References Cited

U.S. PATENT DOCUMENTS 8,395,317 B2 3/2013 Bhattacharya
8,823,395 B2 9/2014 Bhattacharya
(Continued)

FOREIGN PATENT DOCUMENTS

GB 2443208 4/2008

OTHER PUBLICATIONS

International Search Report and written opinion issued for PCT/EP2016/076942 dated Feb. 17, 2017.
(Continued)

*Primary Examiner* — Elizabeth C Imani
(74) *Attorney, Agent, or Firm* — Silvia Salvadori

(57) ABSTRACT

It is disclosed a textile fabric comprising a first set of electrically conductive and externally isolated yarns (22) separated by isolating textile yarns (24); a second set of non-isolated conductive yarns (23); a plurality of textile yarns interlacing the first and the second set of yarns (22, 23), wherein part of the interlacing textile yarns are non-isolated conductive yarns (23) in order to form an electrical grounding grid with the non-isolated conductive yarns (23) of the second set of yarns and part of the interlacing textile yarns are isolating textile yarns (24).

2 Claims, 6 Drawing Sheets

(52) U.S. Cl.
CPC ..... *D10B 2101/20* (2013.01); *D10B 2201/02* (2013.01); *D10B 2331/02* (2013.01); *D10B 2331/04* (2013.01); *D10B 2401/18* (2013.01); *D10B 2403/02431* (2013.01)

(58) Field of Classification Search
CPC ..... D10B 2401/18; D10B 2403/02431; D03D 1/0088; D03D 11/00; D03D 15/0027
See application file for complete search history.

(56) References Cited

U.S. PATENT DOCUMENTS

2003/0119391 A1* 6/2003 Swallow ..... G01L 1/20 442/6
2008/0196783 A1 8/2008 Van Bruggen et al.
2011/0073353 A1* 3/2011 Lee ..... D03D 15/00 174/254
2012/0164405 A1* 6/2012 Webb ..... D06H 1/00 428/196
2017/0126228 A1* 5/2017 Gerken ..... H03K 17/9622

OTHER PUBLICATIONS

International Preliminary Report on patentability dated May 15, 2018 for PCT/EP2016/076942.
European search report dated May 20, 2016 for priority application No. 15193723.2.
First Office Action issued by the CN Patent Office dated Jun. 27, 2019 for corresponding CN application No. 201680059316.5, relevant English translation and local Agent's letter.
Office Action issued by the JP Patent Office dated Sep. 15, 2020 for corresponding JP application No. 2018-523471, relevant English translation and local Agent's letter.

* cited by examiner

TEXTILE FABRIC IMPLEMENTING A CAPACITIVE GRID

RELATED APPLICATIONS

This application is a US national phase application of international application No. PCT/EP2016/076942, filed 8 Nov. 2016, which designates the US and claims priority to European application 15193723.2 filed 9 Nov. 2015, the contents of each of which are hereby incorporated by reference as if set forth in their entireties.

FIELD OF THE INVENTION

The present invention relates to a textile fabric implementing a capacitive grid. In particular, the textile fabric implementing a capacitive grid may be worn on human skin.

BACKGROUND OF THE INVENTION

As it is known, textile research refers to any material made by interlacing fibres and traditionally deals with the types of construction as well as the materials and the methods used to create those constructions.

Modern e-textile applications are known in which electric or electronic technology is coupled with the textile technology for a variety of applications, such as sensors for monitoring the health of the wearer, for providing anti-theft functions, for monitoring the physical activity of the wearer, and so on.

Most sensors are made of separate parts to be put on garments, are either in a solid state (not stretchable) or a non-breathable condition and implement no moisture management or dye-ability features, which are fundamental features for fashion items or textiles in general.

U.S. Pat. No. 8,823,395 B2 discloses an electronic textile and a method for determining a functional area of an electronic textile.

The electronic textile comprises a textile substrate having a first plurality of conductors, a second plurality of conductors and a plurality of capacitors, each capacitor comprising a conductor from the first plurality of conductors and a conductor from the second plurality of conductors, separated by a dielectric, wherein the capacitors are distributed across substantially an entire surface of the electronic textile.

This electronic textile can be tested to determine if the capacitors between the conductive yarns are a part or not of the functional area of the device. The test procedure consists in sending a voltage to selected conductive yarns in order to detect the capacitance of capacitors comprised between the selected crossing yarns and to evaluate if it is part or not of the functional area, namely in order to determine whether or not the LED under investigation is accessible. GB 2 443 208 discloses a textile pressure sensor that is flexible, suitable for producing precise and repeatable measurements of locally applied forces.

This textile pressure sensor operates by measuring the actual capacitance between two crossing core-spun yarns which have an electrically isolating coating over a conductive core.

U.S. Pat. No. 8,395,317 discloses a textile product having a multi-layer warp which includes an upper warp layer comprising an upper array of conductive warp yarns, a lower warp layer comprising a lower array of conductive warp yarns, and an intermediate warp layer arranged between the upper and lower warp layers.

The textile further includes a weft in which a first set of conductive weft yarns cross the upper array of conductive warp yarns, such that electrical contact is achieved therebetween, and a second set of conductive weft yarns cross the lower array of conductive warp yarns, such that electrical contact is achieved therebetween. Such textile product is suitable for several identical components such as LEDs or sensors, namely for stacking LEDs on fabrics for lighting applications.

In textile applications it is problematic to design a capacitive sensor for the human skin because it is easy for the detection elements, such as conductive electrodes, to parasitically and capacitively couple to the body. Such sensors appear to be useless as an addition of finger/hand capacitance does not make a significant change in the time constant of the detection node.

SUMMARY OF THE INVENTION

It is an aim of the present invention to overcome the drawbacks of the prior art in order to create a touch-screen-like textile fabric surface wearable on the human skin able to damp the parasitic capacitance of the portion of human skin on which the textile is worn such that a finger touch is detectable.

Another objective is to create one-direction and two-direction textile swipe sensors wearable on human skin.

Another objective is, while at the same time creating a sensor fabric, to keep at least the minimum essential features of a garment, such as breathability, moisture management, stretchability, dyeability and also fashion appeal.

These and other objects are reached by the present invention by means of a textile fabric comprising:

- a first set of electrically conductive, externally electrically isolated yarns separated by electrically isolating textile yarns;
- a second set of conductive yarns;
- a plurality of textile yarns interlacing the first and the second set of yarns, wherein part of the interlacing textile yarns are conductive yarns in order to form an electrical grounding grid with the conductive yarns of the second set of yarns and part of the interlacing textile yarns are electrically isolating textile yarns.

An effect of the above embodiment is that the electrical grounding grid operates as a barrier to damp the parasitic capacitance of the leg, or other body portion, underneath the capacitive grid such that a finger touch is detectable.

Advantageously, the textile fabric according to the present invention allows an improved detection of a finger touch in a capacitive sensor wearable on human skin.

According to the above embodiment, the first set of electrically conductive, externally electrically isolated yarns, the electrically isolating textile yarns and the second set of conductive yarns form a single textile layer. Advantageously, the above embodiment provides a textile layer that is able to implement the function of sensing external touches, electrically isolating and grounding the parasitic capacitance of a body portion beneath it, being at the same time a very thin layer.

Another advantage of the above embodiment is that the textile fabric as above can be used as a multi-direction swipe-sensitive capacitive sensor.

A further embodiment of the invention provides a swipe-sensitive capacitive sensor comprising:

- a textile fabric having a first set of electrically conductive, externally electrically isolated yarns;
- a second set of conductive yarns; and a plurality of textile yarns interlacing the first and the second set of yarns, wherein part of the interlacing textile yarns are conductive yarns in order to form an electrical grounding grid with the conductive yarns of the second set of yarns and part of the interlacing textile yarns are electrically isolating textile yarns, wherein the yarns of the first set are arranged in a substantially parallel fashion along a direction and are connected to an input stage configured to measure a variation of the capacitance of the yarns of the first set due to the interaction with an external object which parasitically couples its capacitance to the capacitance of the yarns.

Advantageously, the above embodiment provides a double layer textile that can be used as a double direction swipe-sensitive capacitive sensor. In other words, the above embodiment provides a capacitive sensor that can detect a swipe touch along any direction in the plane of the fabric.

Still another embodiment of the invention provides a swipe-sensitive capacitive sensor comprising

- a textile fabric having a first set of electrically conductive, externally electrically isolated yarns,
- a second set of conductive yarns forming an electrical grounding grid,
- a plurality of textile yarns interlacing the first and the second set of yarns, wherein part of the interlacing textile yarns are conductive yarns in order to form an electrical grounding grid with the conductive yarns of the second set of yarns and part of the interlacing textile yarns are electrically isolating textile yarns, wherein the yarns of the first set are arranged in a substantially parallel fashion along a first direction and a second direction and are connected to an input stage configured to measure a variation of the capacitance of each of the yarns of the first set due to the interaction with an external object which parasitically couples its capacitance to the capacitance of the yarns.

Advantageously, the above embodiment provides a multiple direction swipe-sensitive capacitive sensor.

Another advantage of the above embodiment is an improved grounding function of the textile fabric since the bottom portion of the textile fabric, i.e. the portion of the textile fabric in contact with the body portion covered by the fabric, presents only and electrically isolating textile yarns.

Another object of the present invention is an article, preferably a garment, according to claims 15 and 16. The article is characterized by comprising a textile fabric as above discussed.

A further object of the present invention is a method according to claim 17 for producing a textile fabric acting as a swipe sensor and an article as above discussed. The method includes the steps of producing a woven textile fabric comprising at least a set of electrically conductive and externally electrically isolated yarns extending along at least a first region of the fabric, said first region having a first weaving structure according to claim 1, wherein said electrically conductive, externally electrically isolated yarns extend also along at least a second region, said second region having a second weaving structure different from said first weaving structure; cutting the thus obtained fabric along at least a cut-line which extends in the second region, to obtain a plurality of swipe sensor textile portions.

Preferred embodiments are the object of dependent claims.

BRIEF DESCRIPTION OF THE DRAWINGS

The invention will now be described in greater detail, by way of example, with reference to the accompanying non limiting drawings, wherein like numerals denote like elements, and in which.

DETAILED DESCRIPTION OF THE DRAWINGS

Exemplary embodiments will now be described with reference to the enclosed drawings without intent to limit application and uses.

In the following description and figures, the wording "grounding" or "ground terminal" (GND), used for example in the wording "grounding grid", refers to any ground level of potential of an electric circuit, or to any other stable level of potential not necessarily being a ground level for the electric circuit.

Figure 1:
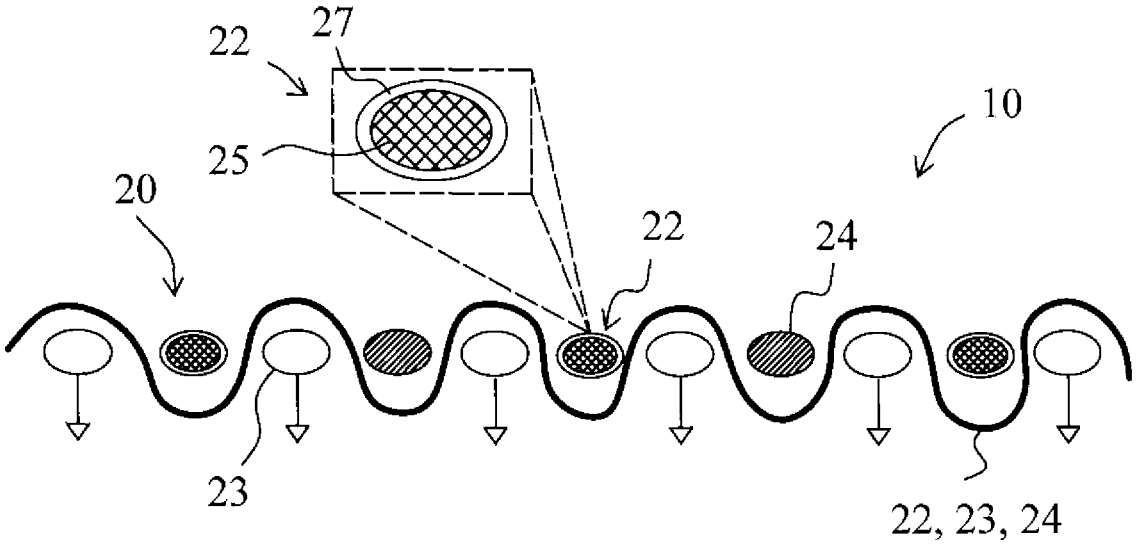
FIG. 1 shows a repeating cell of a woven textile fabric according to a first embodiment of the invention.

In FIG. 1 a repeating cell of a woven textile fabric according to a first embodiment of the invention is shown.

The woven textile fabric 10 of FIG. 1 comprises a first set of electrically conductive, externally electrically isolated yarns 22, and a second set of conductive yarns 23.

The first and the second set of yarns 22, 23 are interlaced by a plurality of interlacing textile yarns, wherein some of the interlacing textile yarns are conductive yarns 23 in order to form an electrical grounding grid with the conductive yarns 23 of the second set of yarns.

Moreover, part of the interlacing textile yarns are conventional electrically isolating textile yarns 24.

Therefore the interlacing textile yarn comprise both electrically isolating and non-electrically isolating yarns. In such a way an electrical grounding grid is formed.

Also, in the textile fabric 10 of FIG. 1, the electrically conductive, externally electrically isolated yarns 22 of the first set of yarns 20 are separated by electrically isolating textile yarns 24.

In the embodiment of FIG. 1, the first and the second set of yarns 22, 23 are warp yarns and the interlacing textile yarns 23, 24 are weft yarns.

In another possible embodiment of FIG. 1, the first and the second set of yarns 22, 23 are warp yarns and the interlacing textile yarns 22, 23, 24 are weft yarns.

Nevertheless, in an alternative embodiment, the first and the second set of yarns 22, 23 may be weft yarns and the interlacing textile yarns 23, 24 or 22, 23, 24 may be warp yarns.

In the textile fabric of FIG. 1, the first set of electrically conductive, externally electrically isolated yarns 22, the electrically isolating textile yarns 24 and the second set of conductive yarns 23 form a single textile layer 20.

The electrically conductive, externally electrically isolated yarns 22 of the first set of yarns are preferably core spun with a conductive center 25 and an electrically isolating external surface 27.

The conductive core 25 of the electrically conductive, externally electrically isolated yarns 22 of the first set of yarns is preferably made of a material chosen from steel, copper, silver or a conductive polymer. For example, the conductive core can be a copper monofilament. Preferably, the monofilament can be tick in the range 30-40 μm, more preferably 35 μm. According to another example, the conductive core can be a two copper monofilaments, in which the detection measure is based on the measure of the mutual capacitance of the two monofilaments with respect to each other.

The electrically isolating external surface 27 of the electrically conductive, externally electrically isolated yarns 22 of the first set of yarns is preferably made of at least one material chosen from cotton, polyester, polyurethane, propylene or another resin.

Referring to the linear mass density of the electrically conductive, externally electrically isolated yarns 22, a core spun yarn can present a cotton, polyester, or viscose fiber blend in the range Ne 120/1-Ne2/1, preferably in the range Ne20/1-Ne6/1.

The conductive yarns 23 are preferably made of steel, or copper, or of steel and/or copper twisted around cotton or of a steel and/or copper cotton blend. According to another embodiment, conductive yarns can be any resistive material without electrical isolation, for example a thermoplastic textile yarn coated by a conductive material or with dispersed conductive impurities such as, but not limited to, carbon black, graphene, CNT, metallic impurities or a combination thereof. For example, embodiments of the invention include conductive yarns with carbon impurities in a 80-denier nylon 6,6 monofilament commercially know under the name RESISTAT F902, R080 MERGE series from Shakespeare Conductive Fibres®, or steel yarns from Bekaert.

Finally, the electrically isolating yarns 24 are preferably made of a textile material chosen from cotton, polyester, nylon or functional derivatives thereof. Moreover, the electrically conductive, externally electrically isolated yarns 22 of the first set of form a sequence of capacitive elements, separated by electrically isolating textile yarns 24, which may be ordinary or conventional textile yarns such as cotton or other textile materials, as depicted in FIG. 2*a-b* which shows two possible embodiments of a top view of the woven textile fabric of FIG. 1.

Figure 2A:
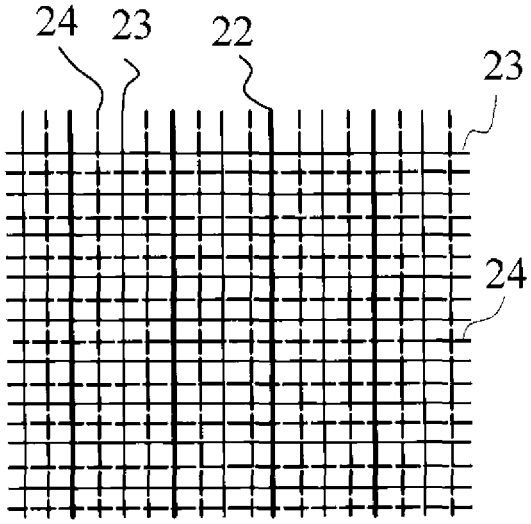
FIG. 2*a* shows a top view of the woven textile fabric of FIG. 1 with warp capacitive sensing yarns.
Figure 2B:
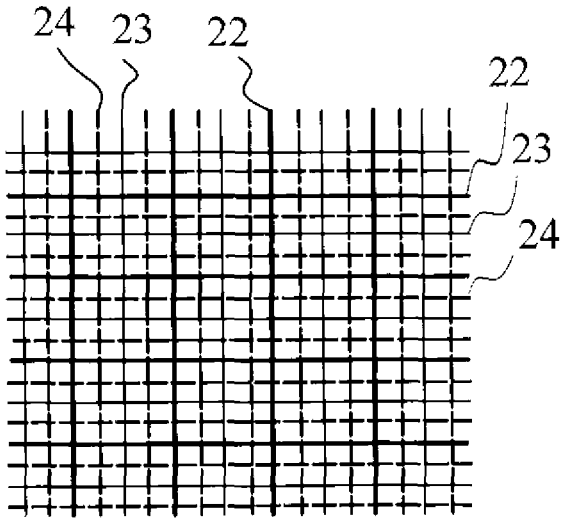
FIG. 2*b* shows a top view of the woven textile fabric of FIG. 1 with warp and weft capacitive sensing yarns.

FIG. 2*a* shows a woven textile fabric in which the electrically conductive, externally electrically isolated yarns 22 are warp only.

According to this first embodiment, the swipe sensor textile can provide information along at least one direction, comprising along the direction orthogonal to the yarns 22, except along the direction parallel to the yarns 22. FIG. 2*b* shows a woven textile fabric in which the electrically conductive, externally electrically isolated yarns 22 are warp and weft.

According to this second embodiment, the swipe sensor textile can provide information along at least one direction, comprising along the direction orthogonal to the yarns 22, and along the direction parallel to the yarns 22. In other words, the swipe sensor textile can provide information along any direction on the plane of the textile.

The conductive yarns 23 form a dense sequence of contacting yarns, electrically connected to an electrical ground reference to provide an electrical grounding grid.

As it will be better explained hereinafter, the above embodiment can be used in a one-directional textile sweep sensor.

Figure 3:
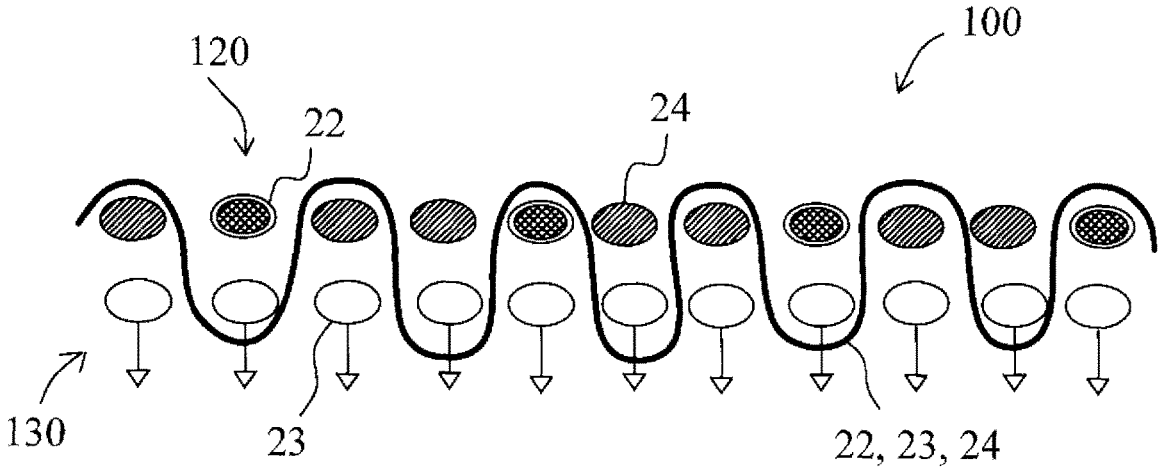
FIG. 3 shows a repeating cell of a woven textile fabric, according to a second embodiment of the invention.

A second embodiment of the invention is represented in FIG. 3 and indicated as textile fabric 100.

In the textile fabric 100, the first set of electrically conductive, externally electrically isolated yarns 22 form a first textile layer 120, and the second set of conductive yarns 23 form a second textile layer 130, the second textile layer 130 being superimposed to the first textile layer 120.

In the embodiment of FIG. 3, the first and the second textile layer 120, 130 are woven together by interlacing textile yarns.

In the embodiment of FIG. 3, part of the interlacing textile yarns are conductive yarns 23 in order to form an electrical grounding grid with the conductive yarns 23 of the second set of yarns of the second textile layer 130 and part of the interlacing textile yarns are electrically isolating textile yarns 24. Also for this embodiment, the first and the second set of yarns 22, 23 may be warp yarns and the interlacing textile yarns 23, 24 or 22, 23, 24 are weft yarns. Nevertheless, in an alternative embodiment, the first and the second set of yarns 22, 23 may be weft yarns and the interlacing textile yarns 23, 24 or 22, 23, 24 may be warp yarns.

Figure 4:
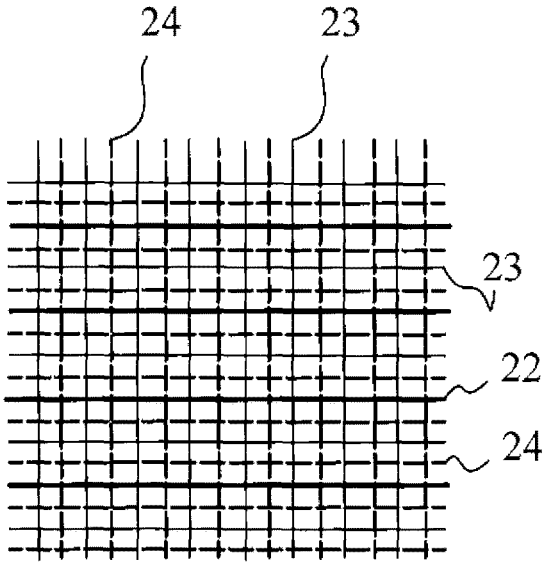
FIGS. 4-5 show, respectively, a bottom and a top view of the woven textile fabric of FIG. 3.

In FIG. 4 a bottom view of the woven textile fabric of FIG. 3 is represented in order to show the electric grounding grid formed by warp conductive yarns 23 interlacing with weft conductive yarns 23.

The bottom layer also shows isolating yarns 24 and electrically conductive, externally electrically isolated yarns 22 which are isolated by virtue of their electrically isolating external surface 27.

Figure 5:
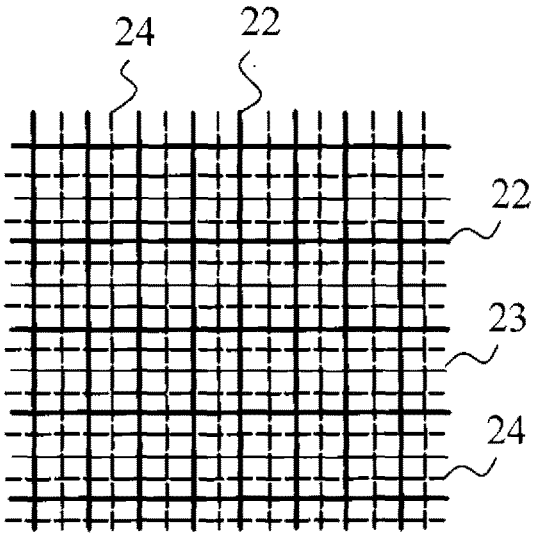

In FIG. 5 a top view of the woven textile fabric of FIG. 3 is represented. In this case, warp electrically conductive, externally electrically isolated yarns 22 interlace with weft electrically conductive, externally electrically isolated yarns 22 to form a sensor layer that can sense sweeping in two different directions, for example two mutually perpendicular directions.

Figure 6:
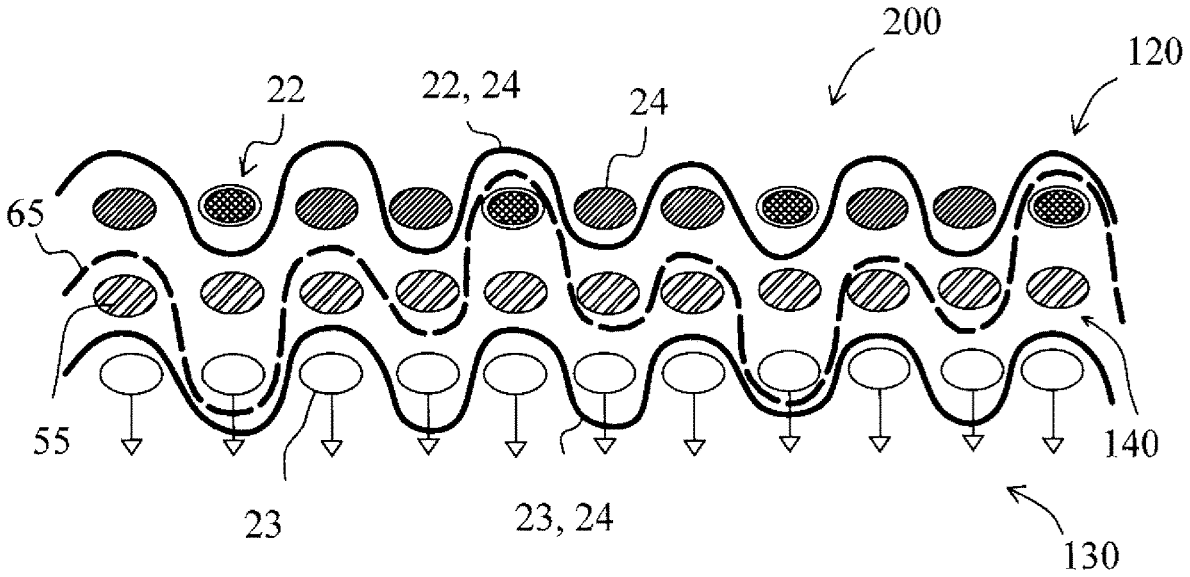
FIG. 6 shows a repeating cell of a woven textile fabric according to a third embodiment of the invention.

A third embodiment of the invention is represented in FIG. 6 and indicated as textile fabric 200.

In the textile fabric 200, the first set of yarns 22 form a first textile layer 120, and the second set of yarns 23 form a second textile layer 130.

The textile fabric 200 of FIG. 6 further comprises a third set of structural electrically isolating yarns 55 forming an intermediate textile layer 140 interposed between the first and second textile layer 120, 130.

Moreover, the textile fabric 200 of FIG. 6 further comprises a plurality of structural electrically isolating yarns 65 interlacing the first and second textile layer and the third intermediate layer 140 of structural yarns 55.

The intermediate textile layer 140 is an actual textile layer, made of ordinary textile yarns 55, 65, such as cotton, polyester or the like and mechanically woven together as any ordinary textile.

In the embodiment of FIG. 6, the second textile layer 130 is woven together by interlacing textile yarns, wherein part of the interlacing textile yarns are conductive yarns 23 in order to form an electrical grounding grid with the conductive yarns 23 of the second set of yarns of the second textile layer 130 and part of the interlacing textile yarns are electrically isolating textile yarns 24.

Figure 7:
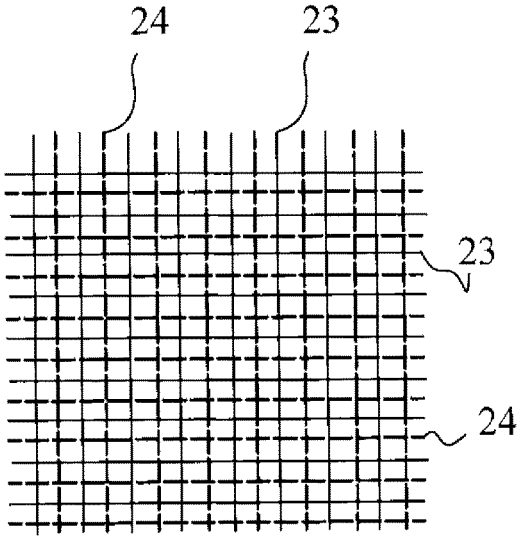
FIGS. 7-8 show, respectively, a bottom and a top view of the woven textile fabric of FIG. 6.

In FIG. 7 a bottom view of the woven textile fabric of FIG. 6 is represented in order to show the electric grounding grid formed by warp conductive yarns 23 interlacing with weft conductive yarns 23.

The first textile layer 120 is woven together by interlacing textile yarns, wherein part of the interlacing textile yarns are electrically conductive, externally electrically isolated yarns 22 that interlace with weft electrically conductive, externally electrically isolated yarns 22 to form a sensor layer.

Figure 8:
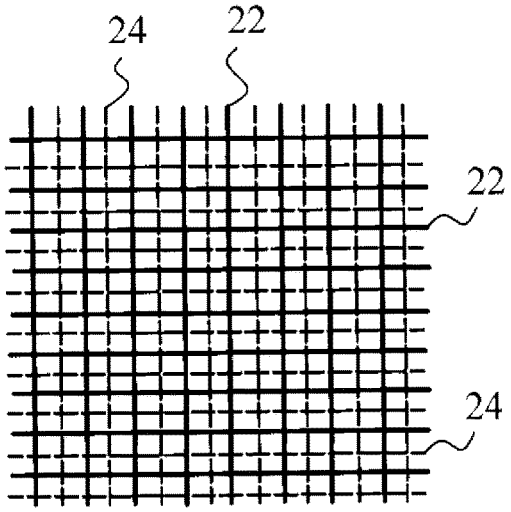

In FIG. 8 a top view of the woven textile fabric of FIG. 6 is represented.

In this case, electrically conductive, externally electrically isolated yarns 22 of warp interlace with weft electrically conductive, externally electrically isolated yarns 22 to form a sensor layer that can sense sweeping in two mutually perpendicular directions.

In any case, also for the embodiment of FIG. 6, the first and the second set of yarns 22, 23 may be warp yarns and the interlacing yarns may be weft yarns. Nevertheless, in an alternative embodiment, the first and the second set of yarns 22, 23 may be weft yarns and the interlacing yarns may be warp yarns. The textile embodiment of FIG. 6 may be used in a two-directional textile sweep sensor.

Figure 9A:
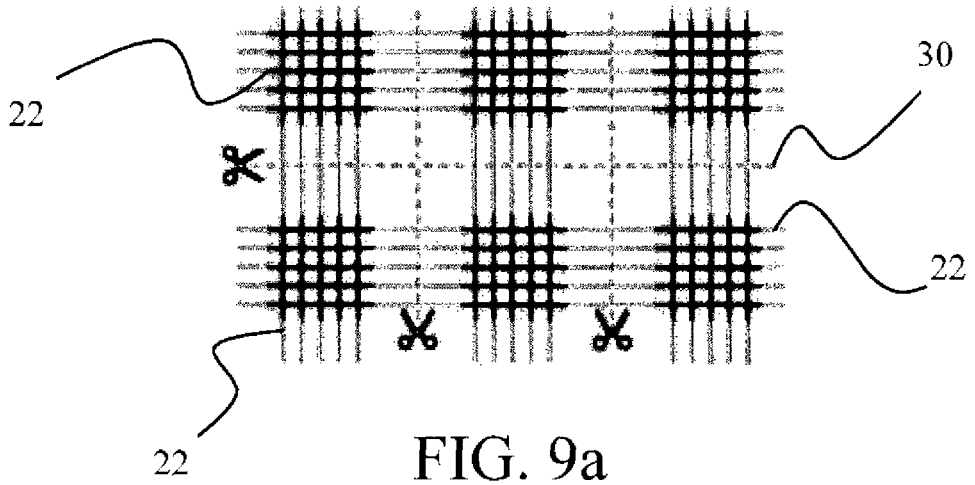
FIG. 9*a* shows a woven swipe sensor textile.
Figure 9B:
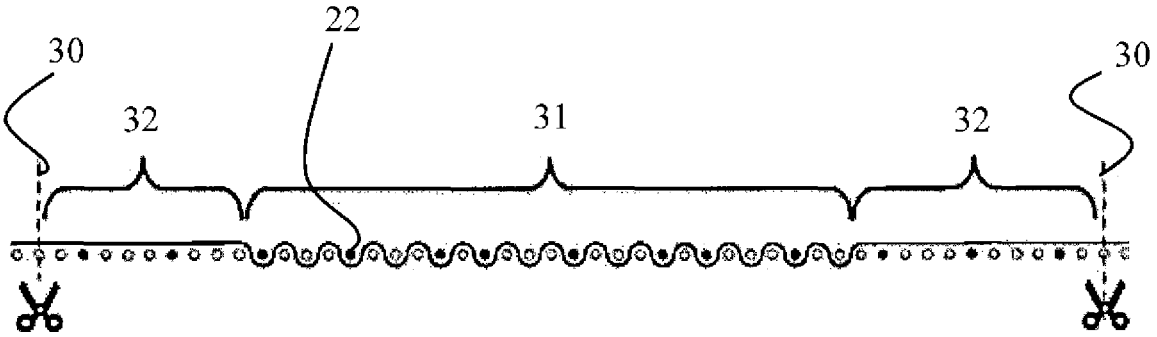
FIG. 9*b* shows a section view of the textile of FIG. 9*a;*
Figure 9C:
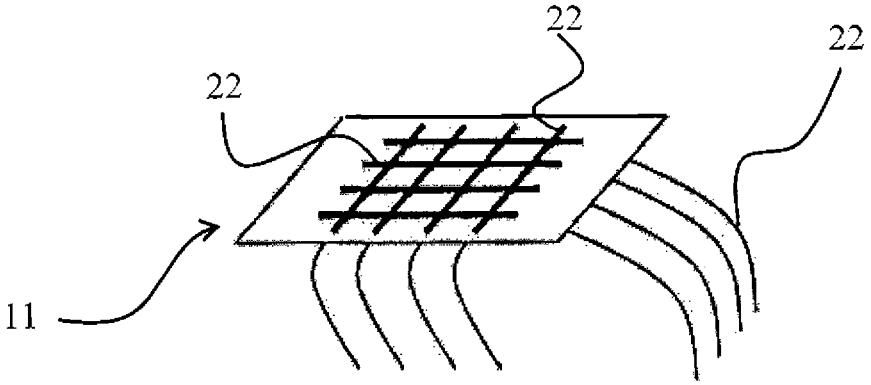
FIG. 9*c* shows a piece of swipe sensor textile obtained from the woven textile of FIG. 9*a;*

FIGS. 9*a-c* show a possible method of producing a textile fabric such as the fabric above disclosed with reference to FIGS. 1-8. The textile fabric according to the present invention can be produced by weaving resulting in a textile as shown in FIG. 9*a*. The woven textile fabric comprises at least a set of electrically conductive, externally electrically isolated yarns 22 for providing the swipe sensing property of the textile fabric.

The electrically conductive, externally electrically isolated yarns 22 extend along at least a first region 31 of the fabric, said first region having a first weaving structure according to claim 1; yarns 22 also extend along at least a second region 32, said second region having a second weaving structure different from said first weaving structure.

More in detail, in said first region 31, the electrically conductive, externally electrically isolated yarns 22 are interlaced with conductive yarns 23 and electrically isolating textile yarns 24. In said second region 32, the electrically conductive, externally electrically isolated yarns 22 are not interlaced with other yarns.

According to another step of the method of the present invention, the fabric as above is cut along at least a cut-line 30 in order to obtain a plurality of swipe sensor textile portions 11, said cut-line 30 extending in said second region 32. Once the swipe sensor textile portions 11 have been obtained, the electrically conductive yarns 22 extending in said second region of the swipe sensor textile portion 11 are connected to an input stage 70 which is preferably connected, according to the embodiments better described in the following, to a microcontroller 80. Part of the electrical insulation of yarns 22 may be removed to carry out the connection. Suitable microcontrollers are known in the art; a suitable microcontroller is disclosed in PCT/EP2016/068187.

The swipe sensor textile portion 11 together with the input stage 70 and the microcontroller 80, form a swipe-sensitive textile 500, 600.

Figure 10:
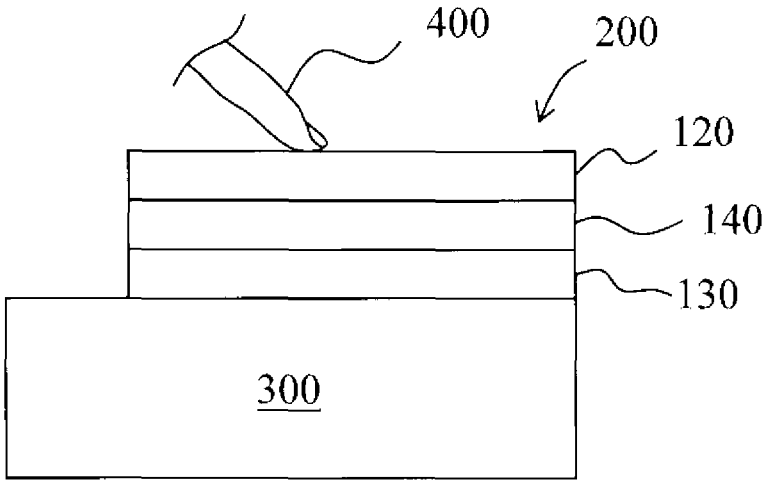
FIG. 10 shows a model of a grounding scheme of the fabric of FIG. 6 as used as a touch sensor.

In other words, the swipe sensor textile portion 11 is a piece of fabric suitable to be wearable and to sense capacitive variations. The swipe-sensitive textile 500, 600 is the textile that by comprising the swipe sensor textile portion 11, the input stage 70 and the microcontroller 80, is able to detect the capacitive variation and to store and/or process the related data. FIG. 10 shows an exemplary model of a grounding scheme of the fabric of FIG. 6, as used as a textile touch or swipe sensor.

In particular, a woven textile fabric 200 is placed over the human skin 300, for example over a leg, with the grounding grid of conductive yarns 23 contacting the human skin 300 and, consequently, the electrically conductive, externally electrically isolated yarns 22 placed in a distal position from the human skin 300.

The conductive cores 25 of the electrically conductive, externally electrically isolated yarns 22 of layer 120 are electrically electrically isolated from each other.

However, when a relatively high capacity object such as a human finger 400 comes into contact with the layer of electrically conductive, externally electrically isolated yarns 22, parasitic capacitive coupling phenomena may occur.

At the same time, the grounding grid of conductive yarns 23 work as a barrier to damp the parasitic capacitance of the leg underneath the capacitive grid such that the finger touch is detectable.

Figure 11:
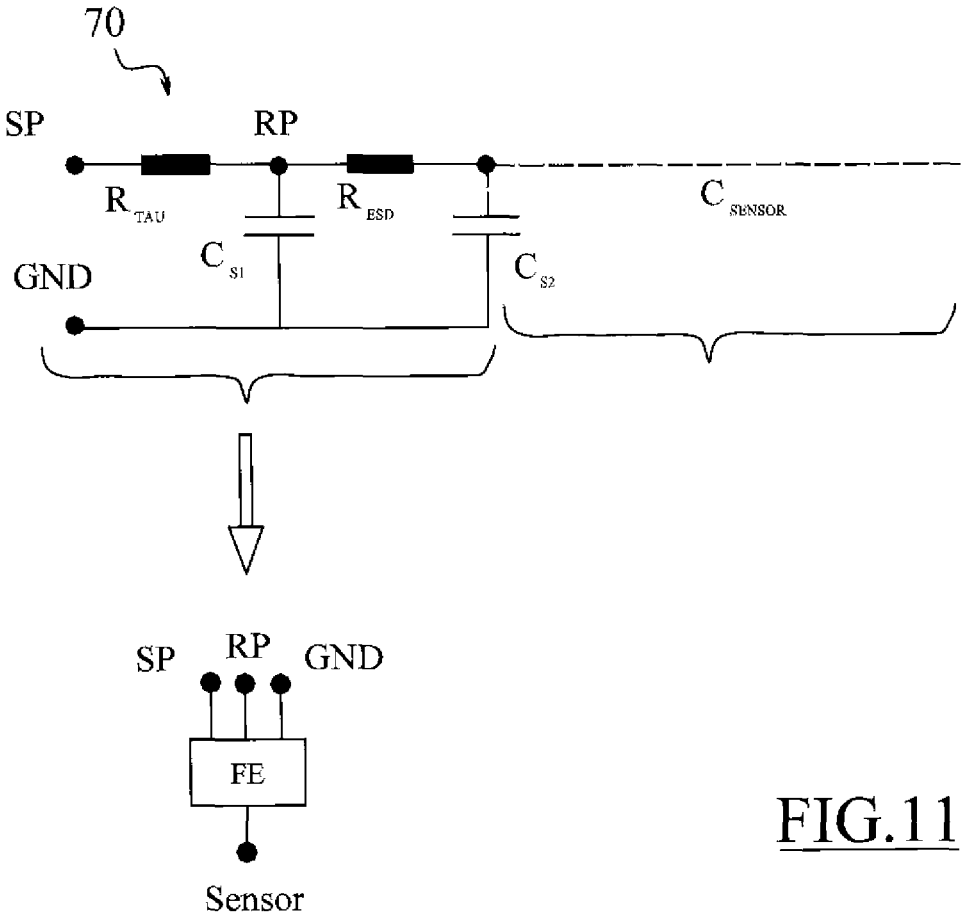
FIG. 11 is a circuitry scheme of an input stage of the textile fabric according to embodiments of the present invention.

FIG. 11 is a circuitry scheme of an input stage 70 for processing signals coming from capacitive sensors.

In this example, the input stage 70 comprises an input terminal S, for receiving a signal coming from a capacitive sensor, such as the woven textile 10, and a ground terminal (GND). These two terminals are connected to electric contacts. The input stage comprises two further terminals SP, RP connected to a microcontroller 80.

The SP and RP terminals are separated by a resistance $R_{T4U}$ that may have values comprised in a range between 0.1 and 40 MΩ and the RP terminal is separated from the textile sensor by a resistance $R_{ESD}$ that may have values comprised in a range between 0.01 and 1 MΩ that gives an Electro Static Discharge protection is in series with the textile sensor.

Turning to the capacitors of the circuit, for stabilization, a small capacitor $C_{S1}$ (100 pF-0.01 μF) from sensor Pin SP to ground GND improves stability and repeatability.

Another small capacitor $C_{S2}$ (20-400 pF), in parallel with the body capacitance, is desirable as it further stabilizes the readings.

In operation, the microcontroller 80 sends a reference signal to the SP (Send Pin) terminal, e.g. a Boolean signal in order to change a logic state. The RP (Receive Pin) terminal replicates this change of logic state with a time delay which is a function of the time constant of the Receiving Pin RP which in turn varies dominantly by the capacitance value of the sensor.

More in detail, the microcontroller 80 is controlled by a software that toggles the Send Pin SP to a new state and then waits for the Receive Pin RP to change to the same state as the Send Pin SP. A software variable is incremented inside a loop to time the state change of the Receive Pin. The software then reports the value of such variable, which may be in arbitrary units.

When the Send Pin SP changes state, it will eventually change the state of the Receive Pin RP. The delay between the changing of the state of the Send Pin SP and the changing of the state of the Receive Pin RP is determined by an RC time constant, defined by R*C, where R is dominantly the value of the resistance $R_{T4U}$ and C is the dominant capacitance at the Receive Pin RP.

If a human finger 400 (or any other capacitance provided object) is connected to the textile sensor, the value C of the capacitance at the Receive Pin RP is changed because the parasitic capacitance $C_{finger}$ of the human finger 400 or of any other capacitance provided object) is added to the value C leading to new value $C'=C+C_{finger}$ of the global capacitance sensed by the sensor.

This fact, in turn, changes the RC time constant of the system to R*C' and, therefore, a different delay between the changing of the state of the Send Pin SP and the changing of the state of the Receive Pin RP is measured by the sensor due to the presence of the human finger 400 (or any other capacitance provided object), namely due to the interaction of the human finger 400 with the textile sensor.

Figure 12:
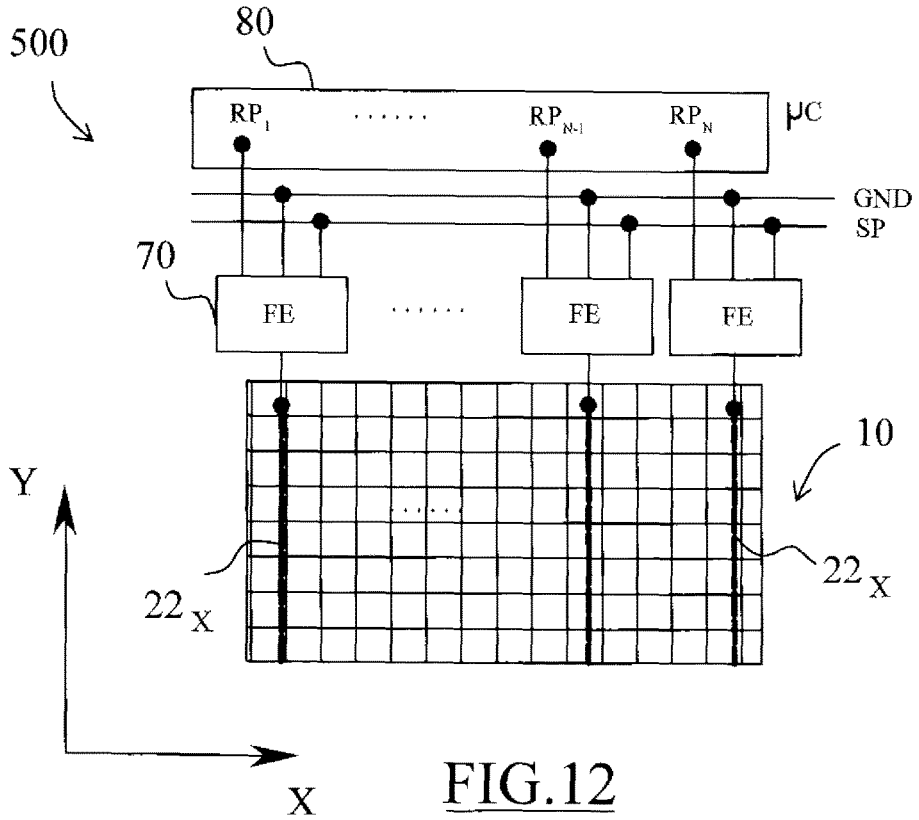
FIG. 12 is a circuitry scheme of a textile single-direction swipe sensor according to an embodiment of the present invention.

FIG. 12 is a circuitry scheme of a textile single-direction swipe sensor 500, according to an embodiment of the present invention.

The sensor 500 of FIG. 12 comprises a textile fabric such as the textile fabric 10, previously described with reference to FIGS. 1-2, the textile fabric 10 having a first set of electrically conductive, externally electrically isolated yarns 22 and a second set of conductive yarns forming an electrical grounding grid.

The first and second set of yarns form a single textile layer and are woven together by a plurality of electrically isolating yarns.

The electrically conductive, externally electrically isolated yarns 22 of the first set are arranged along an Y axis and are referenced for convenience with the numeral 22*x* for reasons that will be apparent hereinafter.

Each of the yarn 22*x* is connected to a corresponding input stage 70 as the one described with reference to FIG. 11.

In turn, each of the input stages 70 is connected to the microcontroller 80 with a respective Receive Pin i RP; where i ranges from 1 to N.

Therefore, if a human finger 400 (or any other capacitance provided object) is passed along the X direction in FIG. 12, each of the Receive Pins RP; of the yarn 22*x* with which the human finger 400 interacts sense a different capacitance as measured by the variation of the RCi time constant of each of the system comprising the yarn 22*x* and the respective input stage 70.

In this way, a one-directional textile swipe sensor along the axis X may be provided.

Figure 13:
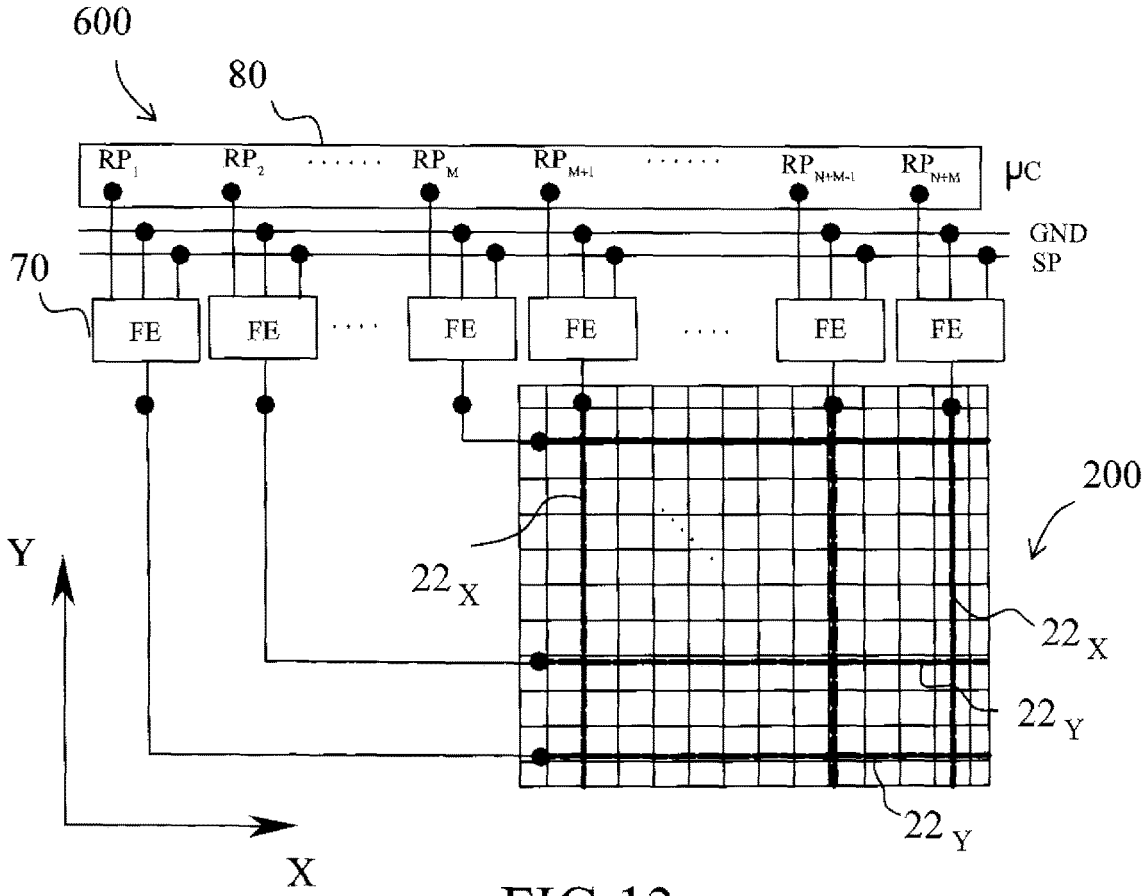
FIG. 13 is a circuitry scheme of a textile double-direction swipe sensor according to another embodiment of the present invention.

FIG. 13 is a circuitry scheme of a textile double-direction swipe sensor 600 according to another embodiment of the present invention.

The sensor 600 of FIG. 13 comprises a textile fabric such as the textile fabric 100 of FIGS. 3-5 or textile fabric 200 of FIGS. 6-8 as previously described. For example, the textile fabric 200 has a first set of electrically conductive, externally electrically isolated yarns 22 and a second set of conductive yarns forming an electrical grounding grid.

The first and second set of yarns form a single textile layer and are woven together by a plurality of electrically isolating yarns.

The electrically conductive, externally electrically isolated yarns 22 of the first set are arranged along two mutually perpendicular direction namely an Y axis and are referenced for convenience with the numeral 22*x* and an X axis and are referenced for convenience with the numeral 22*y* for reasons that will be apparent hereinafter.

Each of the yarns 22*y* is connected to a corresponding input stage 70 as the one described with reference to FIG. 11. In turn, each of the input stages 70 for the yarns 22*y* is connected to a microcontroller with a respective Receive Pin i RPi where i ranges from 1 to M.

Furthermore, each of the yarns 22*x* is connected to a corresponding input stage 70 as the one described with reference to FIG. 11. In turn, each of the input stages 70 for the yarns 22*y* is connected to a microcontroller with a respective Receive Pin i RPM+i where i ranges from M+1 to N.

In operation, if a human finger 400 (or any other capacitance provided object) is passed along the X direction in FIG. 13, each of the Receive Pins RP; of the yarns 22*x* with which the human finger 400 interacts sense a different capacitance as measured by the variation of the RCi time constant of each of the system comprising the yarn 22*x* and the respective input stage 70.

If a human finger 400 (or any other capacitance provided object) is passed along the Y direction in FIG. 13, each of the Receive Pins $RP_{M+i}$ of the yarns 22*y* with which the human finger 400 interacts sense a different capacitance as measured by the variation of the $RC_{M+i}$ time constant of each of the system comprising the yarn 22*y* and the respective input stage 70.

In this way, a two-directional textile swipe sensor along the axis X and Y may be provided.

Of course, the microcontroller 80 of the sensor 600 can combine the information from both directional axis X and Y to detect a movement along a diagonal direction with respect to those axis.

The various embodiments of the invention have been described with reference to a woven textile fabric.

However, the same inventive concepts can be applied to a knitted textile or to a non-woven textile both suitable to implement the same idea of ground-shielded parasitic-capacitance-based touch-sensor fabric.

For example, the textile fabric according to the present invention can comprise a non-woven textile suitable to implement a grounding layer and a woven textile or a knitted textile suitable to implement the capacitive grid touch-sensor.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. A method for producing a textile fabric comprising a first set of electrically conductive, externally electrically isolated yarns (22) separated by isolating textile yarns (24), a second set of conductive yarns (23), a plurality of textile yarns interlacing the first and the second sets of yarns (22, 23), wherein part of the interlacing textile yarns are interlacing conductive yarns (23) that form an electrical grounding grid with the conductive yarns (23) of the second set of yarns and part of the interlacing textile yarns are interlacing isolating textile yarns (24), said method comprising:

a) producing said textile fabric as a woven textile fabric comprising at least said first set of electrically conductive, externally electrically isolated yarns (22) extending along at least a first region (31) of the woven textile fabric, said first region having a first weaving structure, wherein said electrically conductive, externally electrically isolated yarns (22) of said first set extend along at least a second region (32), said second region having a second weaving structure different from said first weaving structure; and b) cutting the woven textile fabric along at least a cut-line (30) in order to obtain a plurality of swipe sensor textile portions (11), said cut-line (30) extending in said second region (32), and c) connecting said electrically conductive, externally electrically isolated yarns (22) extending in said second region of the swipe sensor textile portion (11) obtained by said cutting, to an input stage (70) and/or a microcontroller (80) in order to obtain a swipe-sensitive textile (500, 600).

2. The method according to claim 1, further comprising adding said swipe sensor textile portion (11) or said swipe-sensitive textile (500, 600) to an article.

* * * * *